US010126075B2

(12) United States Patent
Tamura et al.

(10) Patent No.: US 10,126,075 B2
(45) Date of Patent: Nov. 13, 2018

(54) HEAT EXCHANGER AND HEAT TRANSFER TUBE OF THE HEAT EXCHANGER

(71) Applicant: Hitachi, Ltd., Chiyoda-ku, Tokyo (JP)

(72) Inventors: Akinori Tamura, Tokyo (JP); Naoyuki Ishida, Tokyo (JP); Kazuaki Kito, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 125 days.

(21) Appl. No.: 14/609,825

(22) Filed: Jan. 30, 2015

(65) Prior Publication Data

US 2015/0276329 A1 Oct. 1, 2015

(30) Foreign Application Priority Data

Mar. 31, 2014 (JP) ..... 2014-070831

(51) Int. Cl.

| | |
|---|---|
| ***F28F 1/00*** | (2006.01) |
| ***F28F 13/04*** | (2006.01) |
| ***F28F 17/00*** | (2006.01) |
| ***F28D 7/16*** | (2006.01) |

(52) U.S. Cl.

CPC ..... *F28F 13/04* (2013.01); *F28D 7/16* (2013.01); *F28F 17/005* (2013.01)

(58) Field of Classification Search

CPC ..... F28F 13/04; F28F 13/185; F28F 13/187; F28F 17/00; F28F 17/005; F28D 7/16; F28D 2021/0063; F24F 13/22; F24F 13/222; F25D 21/04; F28B 9/08

See application file for complete search history.

(56) References Cited

U.S. PATENT DOCUMENTS 3,358,750 A * 12/1967 Thomas ..... F28B 9/08 165/110
4,253,519 A * 3/1981 Kun ..... F28B 9/08 165/110
4,401,148 A * 8/1983 Yabe ..... F28F 13/04 165/110
5,642,778 A * 7/1997 Gentry ..... F28F 9/0132 165/162

(Continued)

FOREIGN PATENT DOCUMENTS

JP 53-36748 3/1978
JP 53-96558 A 8/1978
JP 53096558 A * 8/1978 ..... F28F 17/00

(Continued)

OTHER PUBLICATIONS

SU_1141292_A1_I machine translation.*

(Continued)

*Primary Examiner* — Len Tran
*Assistant Examiner* — Gordon Jones
(74) *Attorney, Agent, or Firm* — Crowell & Moring LLP

(57) ABSTRACT

A heat exchanger has a tubular structure inside of which a medium flows. The heat exchanger includes a liquid film removal structure and a liquid film flowing-down assistance structure. The liquid film removal structure is joined to the tubular structure. The liquid film flowing-down assistance structure is coupled directly to the liquid film removal structure and is arranged between the tubular structure and an adjacent tubular structure and in parallel to the tubular structure.

4 Claims, 7 Drawing Sheets

(56) References Cited

U.S. PATENT DOCUMENTS

| | | | | |
|---|---|---|---|---|
| 2007/0175234 | A1* | 8/2007 | Pruitt | E03B 3/28 62/310 |

FOREIGN PATENT DOCUMENTS

| | | | | |
|---|---|---|---|---|
| JP | 53-162457 | | 12/1978 | |
| JP | 59-44582 | A | 3/1984 | |
| JP | 59-92388 | U | 6/1984 | |
| JP | 63-32294 | A | 2/1988 | |
| JP | 3-137498 | A | 6/1991 | |
| SU | 1141292 | A1 * | 2/1985 | F28D 7/16 |

OTHER PUBLICATIONS

Office Action issued in counterpart British Application No. GB1423086.6 dated Jun. 9, 2015 (Eight (8) pages).
Japanese-language Office Action issued in counterpart Japanese Application No. 2014-070831 dated Oct. 19, 2017 with unverified English translation (eight pages).

* cited by examiner

A-A' SECTION

B-B' SECTION

A-A' SECTION

B-B' SECTION

HEAT EXCHANGER AND HEAT TRANSFER TUBE OF THE HEAT EXCHANGER

BACKGROUND

1. Technical Field

The present invention relates to a heat exchanger and a heat transfer tube of the heat exchanger.

2. Description of Related Art

An example of a heat transfer tube of a heat exchanger will be described with reference to JP-A-53-96558.

In general, in a heat exchanger such as a condenser or an evaporator, a heat transfer surface for performing heat exchange has a flat plate shape or a tube shape. Especially, a tube-shaped structure is a heat transfer tube and is often used since the manufacture is easy and the attachment is simple. An exchanged heat amount Q(W) on the heat transfer surface for performing heat exchange is determined by the following expression.

$$Q=KA\Delta T \quad (1)$$

Where, $K(W/m^2K)$ is an overall heat transfer coefficient, $A(m^2)$ is a heat transfer area, and $\Delta T$ (K) is a temperature difference between media for performing heat exchange. If the heat transfer area and the temperature difference between media are fixed, as the overall heat transfer coefficient becomes large, the exchanged heat amount becomes large, and the heat transfer performance (exchanged heat amount per unit area and unit temperature difference) becomes high.

These heat transfer tubes are usually vertically arranged. When an outer peripheral surface side of the heat transfer tube is used as a condensation surface, dropwise condensation in which condensed liquid is dispersed in droplets occurs on the upper part of the heat transfer tube. In the dropwise condensation, as condensation advances, a liquid droplet grows and flows down. At that time, the flowing-down liquid droplet wipes out other liquid droplets attached to the heat transfer surface and flows down together. Thus, the heat transfer surface is exposed, and generation and flowing-down of liquid droplets is newly repeated.

By the renewal effect of the heat transfer surface as described above, the overall heat transfer coefficient on the wall surface at the dropwise condensation becomes very large, and heat transfer performance becomes high. On the other hand, at a portion except for the upper part of the heat transfer tube, as the condensed vapor drain flows down, the flowing-down film grows large and becomes heat resistance, and the overall heat transfer coefficient to determine the heat transfer performance is remarkably reduced. Accordingly, there is problem that the length of the heat transfer tube can not be increased.

In order to solve the problem, Patent Literature 1 provides a structure in which parts for vapor drain removal are attached to a heat transfer tube. In order to remove vapor drain, annular parts made of plastic or rubber are attached to the heat transfer tube. The installation position thereof is a position where the vapor drain grows and flows down or the flowing-down film is not yet large. By the structure as stated above, the vapor drain is collected on upper parts of the respective annular parts, fall downward into the air from the outer peripheral sides of the annular parts and is removed. The outer diameter of the annular part is determined so as to prevent the liquid droplet falling into the air from being again attached to the heat transfer tube and from flowing down.

In a portion below the annular part, the flowing-down liquid film is removed and the heat transfer surface is exposed, and therefore, dropwise condensation occurs in which the condensed liquid is dispersed in droplets. Since the overall heat transfer coefficient becomes very large in the dropwise condensation, the heat transfer performance of the heat transfer tube can be improved. Besides, even if the length of the heat transfer tube is increased, the growth of the flowing-down liquid film can be suppressed by adding the annular parts to the heat transfer tube. Accordingly, the problem of the related art in which the length of the heat transfer tube can not be increased can be solved.

Patent Literature 1: JP-A-53-96558

In a vertical multitubular heat exchanger in which heat transfer tube groups are arranged vertically, in order to make the size of the heat exchanger compact, a pitch of the heat transfer tubes is often narrowed to increase the installation density of the heat transfer tubes. If the heat transfer tubes are simply arranged and used while keeping the tube shape, as the vapor drain condensed on the heat transfer surface flows downward, the flowing-down film grows large and becomes heat resistance. Thus, the overall heat transfer coefficient to determine the heat transfer performance is remarkably reduced and the number of required heat transfer tubes is increased.

In the method of installing the annular parts for vapor drain removal disclosed in Patent Literature 1, in each heat transfer tube, the flowing-down liquid film is scattered and removed by the annular part. However, in a tube group shape in which a pitch of heat transfer tubes is narrow, a removed and scattered liquid droplet is again attached to an adjacent heat transfer surface and forms a liquid film. Accordingly, there is a problem that a sufficient liquid film removal effect can not be obtained. Besides, a liquid film is formed also at a portion below the annular part by the reattachment of the scattered liquid droplet from the adjacent tube, and the growth of the flowing-down liquid film can not be suppressed. Accordingly, there is a problem that the length of the heat transfer tube can not be increased.

SUMMARY

An object of the invention is to keep a dropwise condensation shape on a heat transfer tube surface and to obtain high heat transfer performance even in a vertical multitubular heat exchanger including a tube group of narrow pitch.

According to the invention, there are provided a liquid film removal structure joined to a tubular structure, and a liquid film flowing-down assistance structure arranged between the tubular structure and an adjacent tubular structure and in parallel to the tubular structure.

According to the invention, even in the vertical multitubular heat exchanger including the tube group of narrow pitch, the dropwise condensation form on the heat transfer tube surface can be kept, and high heat transfer performance can be obtained.

DESCRIPTION OF EXEMPLARY EMBODIMENTS

Hereinafter, embodiments will be described with reference to the drawings.

Embodiment 1

Figure 1:
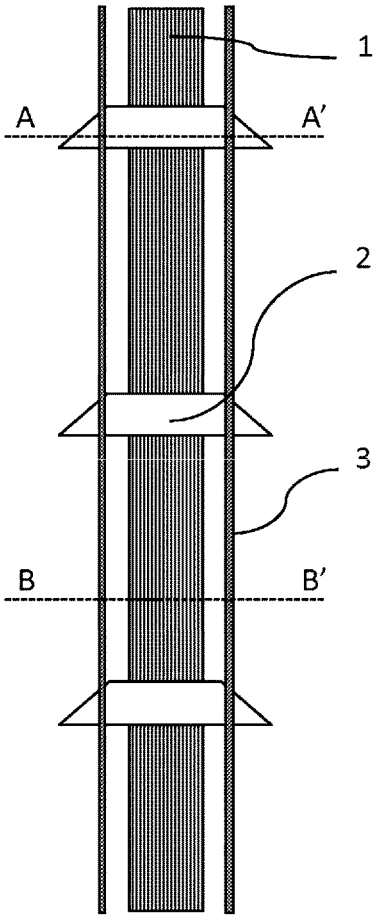
FIG. 1 is a view of a heat transfer tube of embodiment 1 when seen from a side.
Figure 2:
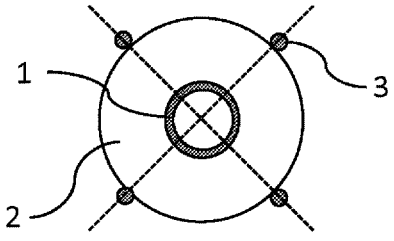
FIG. 2 is a view of the heat transfer tube of the embodiment 1 when seen from above.
Figure 2:
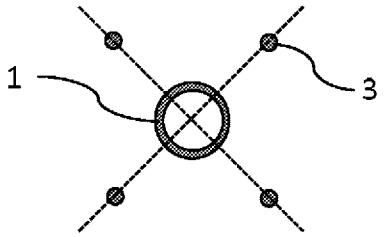

FIG. 1 and FIG. 2 are structural views of a heat transfer tube of this embodiment. FIG. 1 is a view of the heat transfer tube when seen from a side, and FIG. 2 is a view of the heat transfer tube when seen from above. The heat transfer tube of this embodiment includes a tubular structure 1 inside of which a cooling medium flows, a liquid film removal structure 2 joined to the tubular structure 1, and a liquid film flowing-down assistance structure 3 joined to an end part of the liquid film removal structure 2.

The tubular structure 1 is made of, for example, stainless steel generally used as a heat transfer tube material. As another material, copper with high heat conductivity may be used. The surface shape of the tubular structure 1 is a smooth surface. A slit structure may be provided in order to increase a heat transfer area. The annular liquid film removal structure 2 is attached to the heat transfer surface in order to remove a flowing-down liquid film of a vapor drain flowing down along the heat transfer surface of the tubular structure 1. In this embodiment, although the shape of the liquid film removal structure 2 is circular, the shape may be elliptical or polygonal.

The material of the liquid film removal structure 2, may be any material, such as plastic, rubber or stainless steel, having sufficient strength to remove the liquid film. The liquid film removal structure 2 is joined to the tubular structure 1 by fitting using elasticity of the material or by welding. The installation position of the liquid film removal structure 2 is a position where the flowing-down liquid film due to the flowing-down vapor drain does not become large.

The liquid film flowing-down assistance structure 3 is joined to the end part of the liquid film removal structure 2. The liquid film flowing-down assistance structure 3 is a rod-like structure installed in parallel to the tubular structure 1, and is arranged so as to connect the end parts (outer edge parts) of the adjacent liquid film removal structures 2. In this embodiment, although the number of the liquid film flowing-down assistance structures 3 is four per one tubular structure 1, the number of the liquid film flowing-down assistance structures 3 is not limited. Besides, in this embodiment, although the sectional shape of the liquid film flowing-down assistance structure 3 is circular, the shape may be elliptical or polygonal.

The material or the surface structure of the liquid film flowing-down assistance structure 3 has higher wettability than the joined liquid film removal structure 2. If the material of the liquid film removal structure 2 is made of stainless steel, for example, stainless steel with roughed surface is used for the material and the surface structure of the liquid film flowing-down assistance structure 3.

The liquid film flowing-down assistance structure 3 is joined to the liquid film removal structure 2 by soldering or welding. By the structure as described above, a vapor drain condensed on the surface of the tubular structure 1 is collected on the upper part of the liquid film removal structure 2, and flows down along the liquid film flowing-down assistance structure 3 joined to the end part of the liquid film removal structure 2. Since the liquid film flowing-down assistance structure 3 has a more wettable surface than the liquid film removal structure 2, a liquid film once attached to the liquid film flowing-down assistance structure 3 is not returned to the liquid film removal structure 2 but flows down.

Since the vapor drain collected on the upper part of the liquid film removal structure 2 is not scattered into the air but flows down along the liquid film flowing-down assistance structure 3, reattachment of a droplet scattered from the adjacent tube can be suppressed even in the tube group shape in which the pitch of the heat transfer tubes is narrow. Accordingly, even in the tube group shape in which the pitch of the heat transfer tubes is narrow, the flowing-down liquid film is removed at a portion below the liquid film removal structure 2, and the heat transfer surface is exposed.

Thus, dropwise condensation occurs in which the condensed liquid is dispersed in droplets. Since the overall heat transfer coefficient becomes very large in the dropwise condensation, the heat transfer performance of the heat transfer tube can be improved. Besides, even if the length of the heat transfer tube is increased, the growth of the flowing-down liquid film can be suppressed. Accordingly, such a problem can be solved that the length of the heat transfer tube can not be increased in the tube group shape in which the pitch of the heat transfer tubes is narrow.

Figure 3:
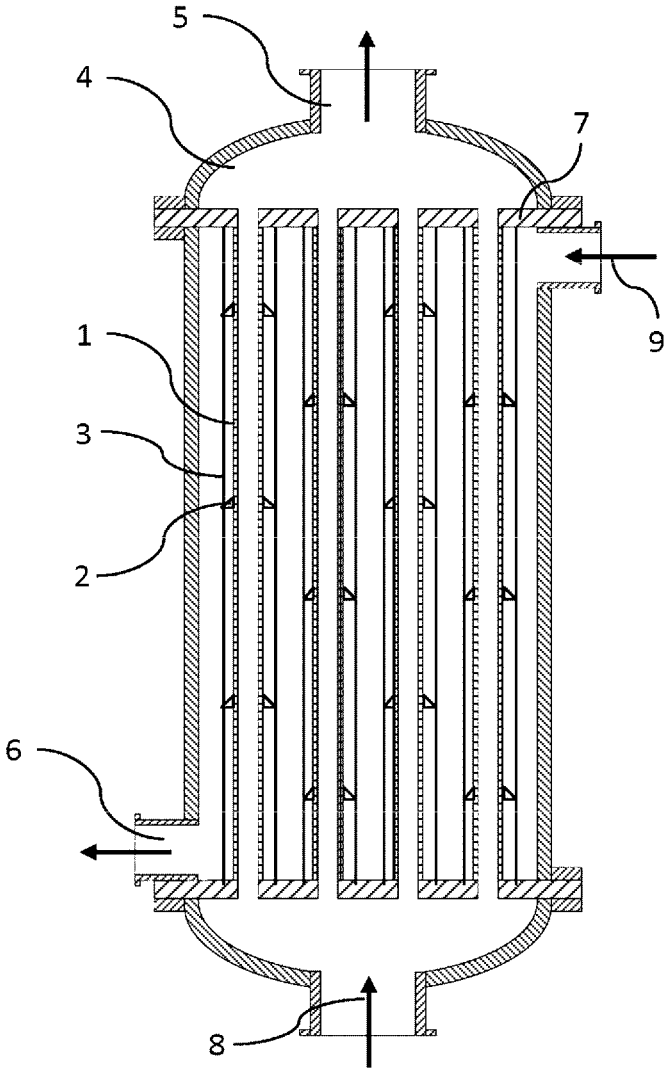
FIG. 3 is a view showing a vertical multitubular heat exchanger including heat transfer tubes of embodiments 1 to 4.

FIG. 3 is a view showing a vertical multitubular heat exchanger using the heat transfer tube of this embodiment. The vertical multitubular heat exchanger 4 includes the tubular structure 1, the liquid film removal structure 2, the liquid film flowing-down assistance structure 3, a primary nozzle 5, a secondary nozzle 6, and a tube plate 7 for supporting the heat transfer tube.

The tubular structure 1 and the liquid film flowing-down assistance structure 3 are joined to the tube plate 7 by soldering or welding. A primary medium 8 flows in the tubular structure 1, and a secondary medium 9 flows through the secondary nozzle 6. Since the heat transfer performance of the heat transfer tube is improved by the liquid film removal structure 2 and the liquid film flowing-down assistance structure 3, the size of the vertical multitubular heat exchanger 4 can be made compact. Besides, since the growth of a liquid film flowing down along the heat transfer tube can be suppressed by the liquid film removal structure 2 and the liquid film flowing-down assistance structure 3, the length of the heat transfer tube can be increased.

Embodiment 2

Figure 4:
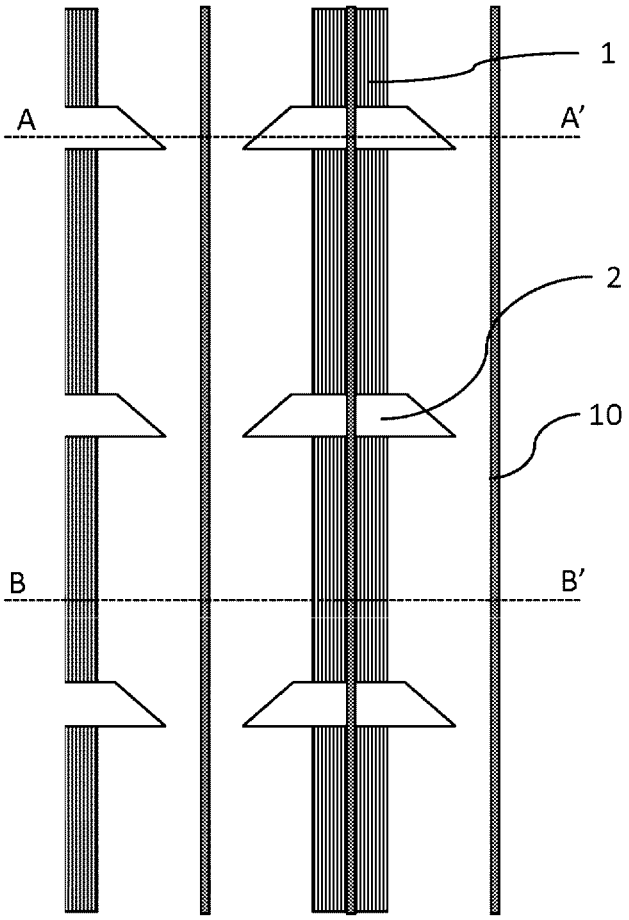
FIG. 4 is a view of a heat transfer tube of the embodiment 2 when seen from a side.
Figure 5:
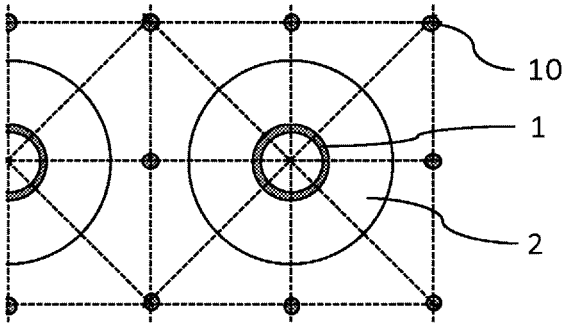
FIG. 5 is a view of the heat transfer tube of the embodiment 2 when seen from above.
Figure 5:
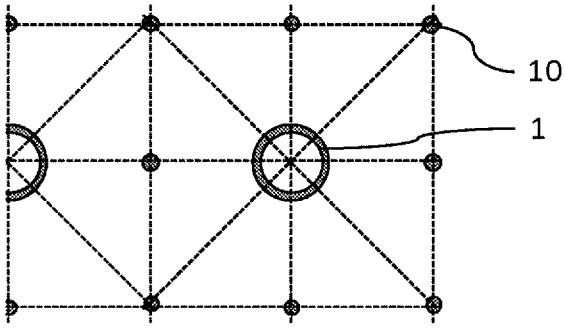

FIG. 4 and FIG. 5 are structure views of a heat transfer tube of this embodiment. FIG. 4 is a view of the heat transfer tube when seen from a side, and FIG. 5 is a view of the heat transfer tube when seen from above. The heat transfer tube of this embodiment includes a tubular structure 1 inside of which a cooling medium flows, a liquid film removal structure 2 joined to the tubular structure 1, and a liquid film flowing-down assistance structure 10 installed in a space part between adjacent tubes.

The tubular structure 1 and the liquid film removal structure 2 are the same as those of the embodiment 1. The liquid film flowing-down assistance structure 10 is installed in the space part between the adjacent tubes, and the end part thereof is joined to the tube plate 7. In this embodiment, although the number of the liquid film flowing-down assistance structures 10 is eight per one tubular structure 1, the number is not limited. In this embodiment, although the sectional shape of the liquid film flowing-down assistance structure 10 is circular, the shape may be elliptical or polygonal. The material and the surface structure of the liquid film flowing-down assistance structure 10 have high wettability, and for example, stainless steel with roughed surface is used.

The liquid film flowing-down assistance structure 10 is joined to the tube plate 7 by soldering or welding. By the structure as described above, a vapor drain which is condensed on the surface of the tubular structure 1 is collected on an upper part of the liquid film removal structure 2, and is scattered from the end part of the liquid film removal structure 2 into the air in droplets. Most of the scattered liquid droplets are again attached to the liquid film flowing-down assistance structure 10 installed in the space part between the adjacent tubes and flow down.

Thus, even in the tube group shape in which the pitch of the heat transfer tubes is narrow, reattachment of the liquid droplets scattered from the adjacent tube can be suppressed. Accordingly, even in the tube group shape in which the pitch of the heat transfer tubes is narrow, the flowing-down liquid film is removed at a portion below the liquid film removal structure 2, and the heat transfer surface is exposed. Thus, dropwise condensation occurs in which condensed liquid is dispersed in droplets. Since the overall heat transfer coefficient becomes very high in the dropwise condensation, the heat transfer performance of the heat transfer tube can be improved. Besides, even if the length of the heat transfer tube is increased, the growth of the flowing-down liquid film can be suppressed.

Accordingly, such a related art problem can be solved that the length of the heat transfer tube can not be increased in the tube group shape in which the pitch of the heat transfer tubes is narrow. As compared with the embodiment 1, since the liquid film flowing-down assistance structure 10 can be arranged to be shared by the adjacent tubes, the number of the liquid film flowing-down assistance structures 10 can be decreased, and the cost of the installation of the liquid film flowing-down assistance structures 10 can be reduced. Besides, as compared with the embodiment 1, since the welding points of the liquid film flowing-down assistance structures 10 can be reduced, the cost of the installation of the liquid film flowing-down assistance structures 10 can be reduced.

Embodiment 3

Figure 6:
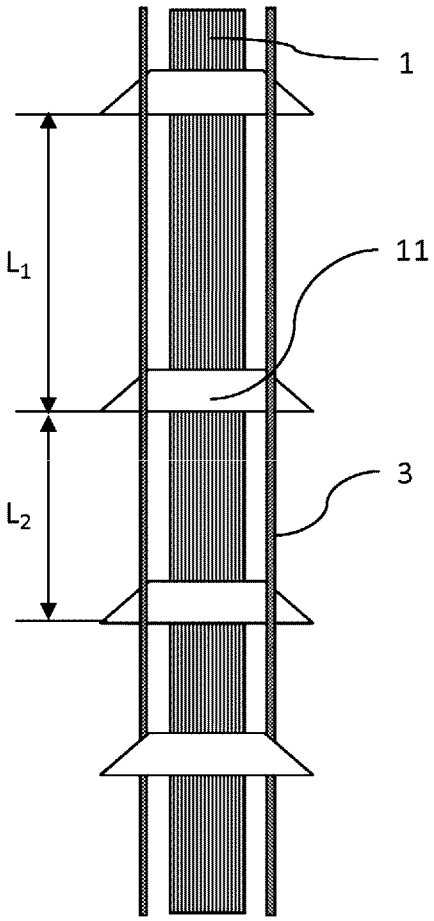
FIG. 6 is a view of a heat transfer tube of the embodiment 3 when seen from a side.

FIG. 6 is a structural view of a heat transfer tube of this embodiment. The heat transfer tube of this embodiment includes a tubular structure 1 inside of which a cooling medium flows, a liquid film removal structure 11 joined to the tubular structure 1, and a liquid film flowing-down assistance structure 3 joined to an end part of the liquid film removal structure 11. The tubular structure 1 and the liquid film flowing-down assistance structure 3 are the same as those of the embodiment 1. The annular liquid film removal structure 11 is attached to a heat transfer surface in order to remove a flowing-down liquid film of vapor drain flowing down along the heat transfer surface of the tubular structure 1. In this embodiment, although the shape of the liquid film removal structure 11 is circular, the shape may be elliptical or polygonal.

The material of the liquid film removal structure 11, may be any material, such as plastic, rubber or stainless steel, having sufficient strength to remove the liquid film. The liquid film removal structure 11 is joined to the tubular structure 1 by fitting using elasticity of the material or by welding. The installation interval of the liquid film removal structures 11 is set to be decreased downwardly, that is, $L2<L1$. The amount of vapor drain is small at an upper portion of the heat transfer tube, and is increased downwardly. Thus, by using the structure as described above, the liquid film of the vapor drain can be efficiently removed by a small number of the liquid film removal structures 11.

Embodiment 4

Figure 7:
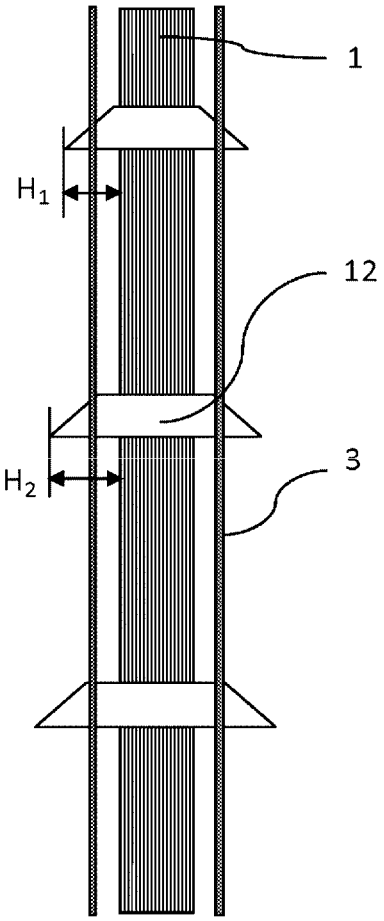
FIG. 7 is a view of a heat transfer tube of the embodiment 4 when seen from a side.

FIG. 7 is a structural view of a heat transfer tube of this embodiment. The heat transfer tube of this embodiment includes a tubular structure 1 inside of which a cooling medium flows, a liquid film removal structure 12 joined to the tubular structure 1, and a liquid film flowing-down assistance structure 3 joined to the liquid film removal structure 12. The tubular structure 1 and the liquid film flowing-down assistance structure 3 are the same as those of the embodiment 1. The annular liquid film removal structure 12 is attached to a heat transfer surface in order to remove a flowing-down liquid film of vapor drain flowing down along the heat transfer surface of the tubular structure 1. In this embodiment, although the shape of the liquid film removal structure 12 is circular, the shape may be elliptical or polygonal.

The material of the liquid film removal structure 12, may be any material, such as plastic, rubber or stainless steel, having sufficient strength to remove the liquid film. The liquid film removal structure 12 is joined to the tubular structure 1 by fitting using elasticity of the material or by welding. The heights of the liquid film removal structures 12 are set to be increased downwardly, that is, $H2<H1$. Here, the "height of the liquid film removal structure 12" is a distance from the outer peripheral part of the tubular structure 1 to the outer edge part of the liquid film removal structure 12 when seen in the horizontal section of the heat transfer tube. Accordingly, if the liquid film removal structure 12 is circular, the height is the distance in the radius direction. The amount of vapor drain is small at an upper portion of the heat transfer tube and is increased downwardly. Accordingly, by the structure as described above, the liquid film of the vapor drain can be efficiently removed by the low-height liquid film removal structure 12.

What is claimed is:

1. A heat exchanger, comprising:

a plurality of tubular structures;

liquid film removal structures joined to the tubular structures; and liquid film flowing-down assistance structures that are coupled directly to the liquid film removal structure and that is arranged between the tubular structure and an adjacent tubular structure and in parallel to the tubular structure, wherein a number of the liquid film flowing-down assistance structures is eight per each tubular structure, and each tubular structure is configured such that, along a longitudinal direction of the heat exchanger, the liquid film removal structures on a first side of each tubular structure are offset with respect to the liquid film removal structures on a second side of each tubular structure that is opposite to the first side, and along a longitudinal direction of the heat exchanger each of the liquid film removal structures in one of the plurality of tubular structures is positioned at a same position as each of the liquid film removal structures in another of the plurality of tubular structures immediately adjacent thereto.

2. The heat exchanger according to claim 1, wherein the liquid film flowing-down assistance structures are made of a material with higher wettability than the liquid film removal structures and is installed at an end part of the liquid film removal structures.

3. The heat exchanger according to claim 1, wherein an installation interval of the liquid film removal structures decreases downwardly.

4. The heat exchanger according to claim 3, wherein the liquid film removal structures have different heights.

* * * * *